United States Patent [19]

Smith

[11] Patent Number: 4,796,894

[45] Date of Patent: Jan. 10, 1989

[54] BOARD GAME APPARATUS AND METHOD

[76] Inventor: Donald G. Smith, 507 Tufts Ave., Burbank, Calif. 91504

[21] Appl. No.: 69,838

[22] Filed: Jul. 6, 1987

[51] Int. Cl.[4] ..... A63F 3/00

[52] U.S. Cl. ..... 273/244; 273/259; 273/290

[58] Field of Search ..... 273/247, 244, 259, 282 R, 273/290

[56] References Cited

U.S. PATENT DOCUMENTS

| | | | |
|---|---|---|---|
| 2,794,642 | 6/1957 | O'Neill | 273/290 |
| 4,094,509 | 6/1978 | Barron | 273/247 |

FOREIGN PATENT DOCUMENTS

| | | | |
|---|---|---|---|
| 195201 | 3/1923 | United Kingdom | 273/247 |
| 398179 | 9/1933 | United Kingdom | 273/247 |
| 429139 | 5/1935 | United Kingdom | 273/259 |
| 638159 | 5/1950 | United Kingdom | 273/247 |
| 2029707 | 3/1980 | United Kingdom | 273/259 |

*Primary Examiner*—Richard C. Pinkham

*Assistant Examiner*—Benjamin H. Layno

*Attorney, Agent, or Firm*—Nilsson, Robbins, Dalgarn, Berliner, Carson & Wurst

[57] ABSTRACT

A game apparatus having a board, pieces, pegs and cubes. The board has a grid of spaces and several columns of holes. A margin separates the spaces from the edge of the board. One column of holes occupies the grid of spaces. The other columns occupy the margin. The pieces have holes and are designed for movement on the spaces. One of the pegs is moved between the holes in the spaces and the holes in the pieces. The other pegs are moved between the holes in the margin. The players take turns making plays. Each play ends with the move of a peg. The players take turns being the offense. In appropriate situations, the defensive player rolls a pair of cubes. If one or more symbols on the faces of the cubes are positive, the defense moves a peg from a hole in a space or a piece to another piece or another hole in a space. The first player unable to move a peg at the end of their turn loses the game.

7 Claims, 4 Drawing Sheets

BOARD GAME APPARATUS AND METHOD

FIELD OF THE INVENTION

This invention relates to a new and useful improvement in board games and more particularly a board game simulating a basketball game. The game is called Fastbreak.

DESCRIPTION OF THE PRIOR ART

Many games with boards, pieces, and dice have been created to simulate the court game of basketball. In general the pieces are moved from space to space of the board, until the player controlling the "ball" decides to shoot it. Usually dice are rolled and the dots on the upper faces compared to a chart, in order to determine the range of movement and success of the shots. Such games may be statistically accurate, but constant reference to a chart is cumbersome and time consuming.

A game called playoff basketball dispenses with such charts by providing three different cubes. It is played on a board divided into two halves, each half having 5 holes. Each player is provided with a distinctly colored peg. The players use the cubes to move their pegs, to attempt shots and free throws.

Each cube has six faces. Each face has an expression. The expressions on the faces of the movement cube are: pass to guard, pass to forward, pass to center, offensive foul, turn over and fast break. The expressions on the shot cube are: foul, two each of no good, and three each of 2 points. The expressions on the faces of the free throw cube are: two each of no good and four each of good 1 point.

The players alternate using the movement cube to "pass" their peg from hole to hole of the board. Provided they avoid turning over the "ball", after two successful passes the player can roll the shot cube. The "shot" will either be good, no good or a foul will be called. In the later case, the player rolls the free throw cube. This "shot" is either good or no good.

In that the game provides the players with only one peg and no pieces, the competition between the "players" is unrepresentable. In that the board has no column of holes for tabulating, the score must be kept on a separate piece of paper. In that the faces of the movement cube do not have the expressions "steal", "block", and "intercept"; these common features of a basketball game are absent. In that there is no hole at the goals, it is not possible to simulate the movement of the "ball" into the goal.

SUMMARY OF THE INVENTION

It is therefor one object of this game to provide the players with pieces and pegs, thus providing the players with players and a "ball".

It is therefor one object of this game to provide the players with a column of holes for tabulating, thus releasing the players from looking to a separate piece of paper for the score.

It is a further object of this game to provide the players with cubes having faces with the expressions: "steal38 and "block"; thus providing the players with situations which actually happen in a basketball game.

Still a final object is to have a hole at the goals, thus providing the players with a simulation of a "ball" apart from the "players".

Fastbreak is a game of strategy and chance. It includes a board, pieces, pegs and cubes. The board has holes and spaces. The spaces form a grid having horizontal, vertical and diagonal rows. The holes form vertical-columns inside and outside of the grid. The holes of the inner-column occupy the center and goal spaces. The holes of the outer-columns are arranged to form groups of holes, called time and score groups.

Initially, the object-peg is positioned in the hole of the center-space. Each time-peg is positioned in the hole of a time group. Each score-peg is positioned in the hole of a score-group. The pieces are divided into color contrasting sets. Each player places some of the pieces of their set on the spaces.

Players take turns controlling the object-peg. During a turn, players alternate making offensive and defensive plays. The offense moves pieces and the object-peg. The defense moves pieces and a time-peg, or the object-peg or a score-peg. Pieces are moved along the rows of the grid. Each play ends with the move of a peg.

The offensive player uses their pieces to maneuver the object-peg towards the oppositions goal space. The object-peg is move from spaces to pieces and from piece to piece; and eventually from a piece to the oppositions goal space. If the defense is unable to remove the object-peg from their own goal, then they must move the oppositions score-peg. If they are unable to move the score-peg then the offense wins the game.

The defensive player uses their pieces to defend their goal space. Pieces are used to block the object-peg and in attempt to force the offense to turn over the object-peg. In each violation and in some situation, the offense turns over the object-peg. After time, recovery and goal-area violations the object peg is moved to the hole of a space. The pieces are reset and the (new) offensive player makes a play.

The situations are: steal, intercept, block and defend. In steal and block, a defensive piece is adjacent with a piece having the object-peg. In intercept and defend, a defensive piece is between a piece and the object-peg. In each situation, the defender may roll a pair of cubes. If the required number of symbols on the upper faces of the cubes correspond with the situation, then the defensive player awards the object-peg to a new piece, perhaps a defensive one.

A detailed disclosure following, related to the drawings, describes a preferred embodiment of the apparatus according to the invention which are expressible in structure and method other than described and illustrated.

PREFERRED EMBODIMENT

FIG. 1

Figure 1:
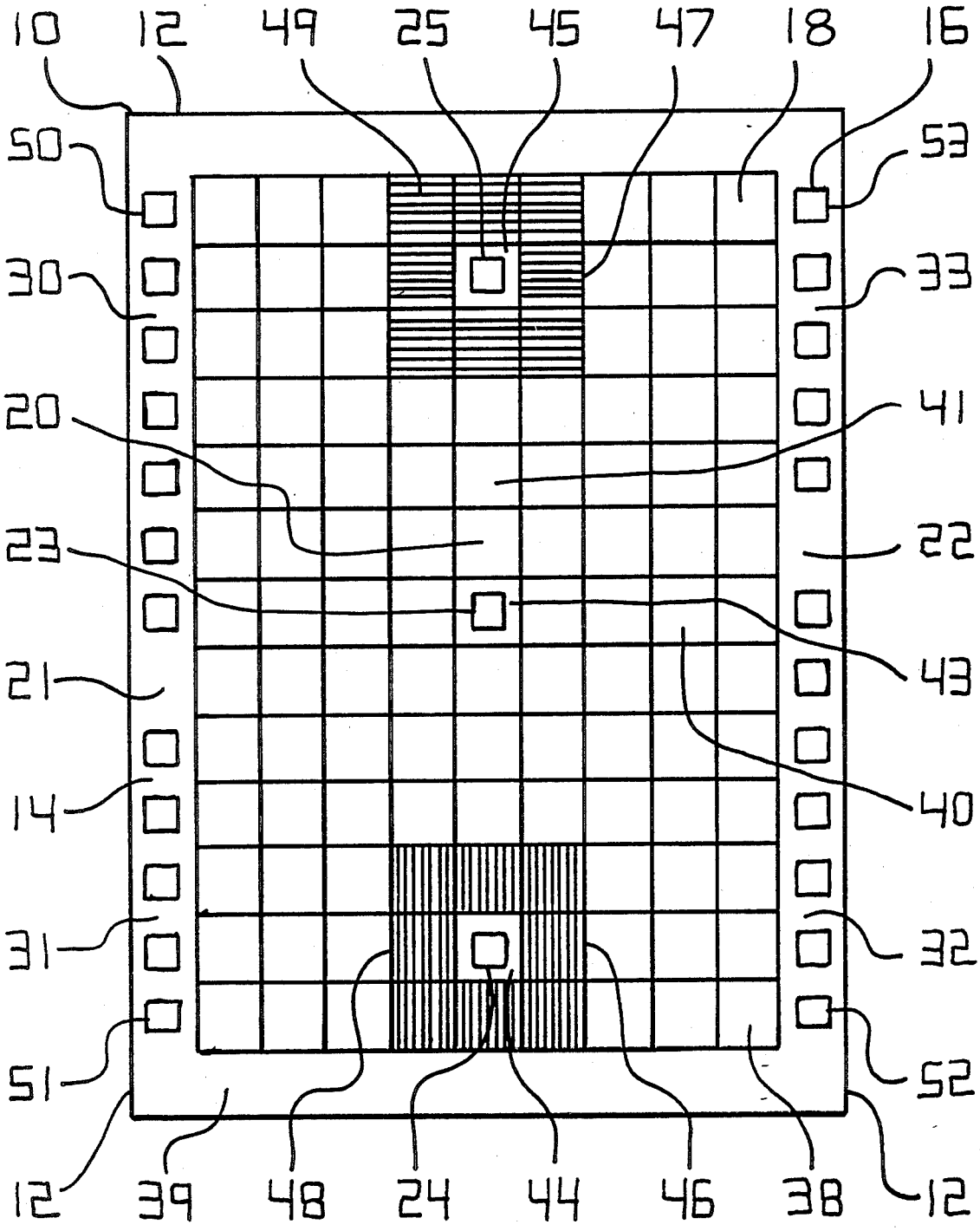
FIG. 1 is a plan view of a game board having a grid of spaces surrounded by a margin, and 3 vertical-columns of holes; showing the goal spaces and the adjacent colored goal areas.
Figure 2:
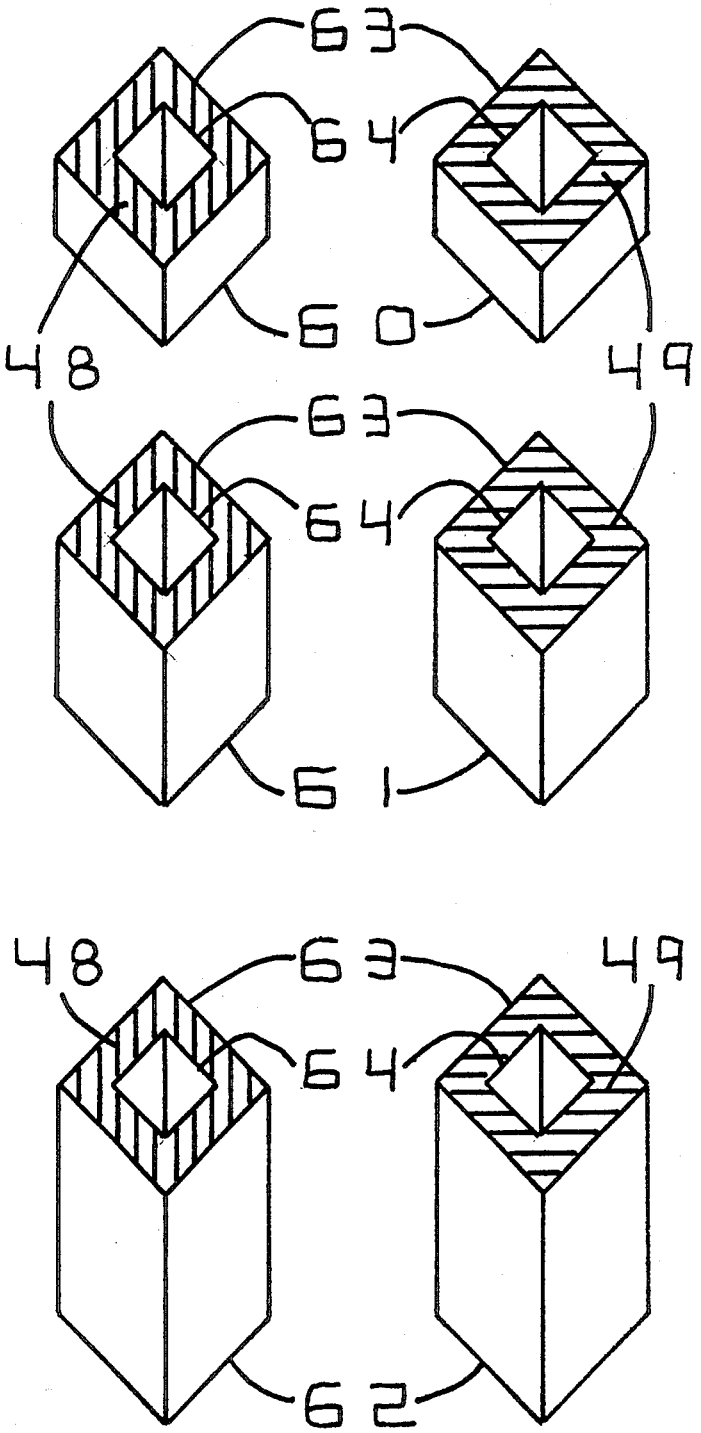
FIG. 2 is a detailed view of the colored game pieces showing the three types of pieces.
Figure 3:
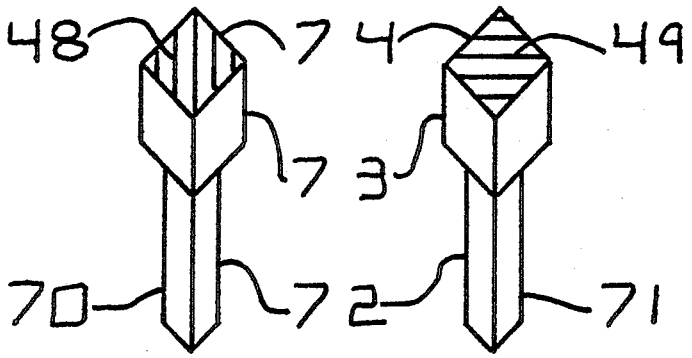
FIG. 3 is a detailed view of the colored game pegs.
Figure 4:
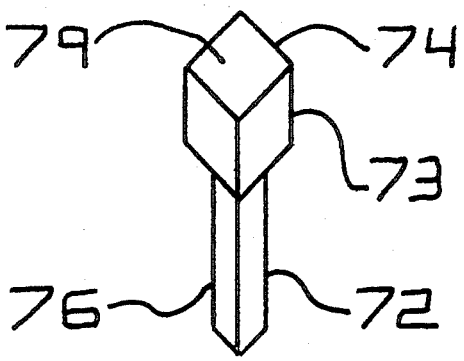
FIG. 4 is a detailed view of the uncolored game peg.
Figure 5:
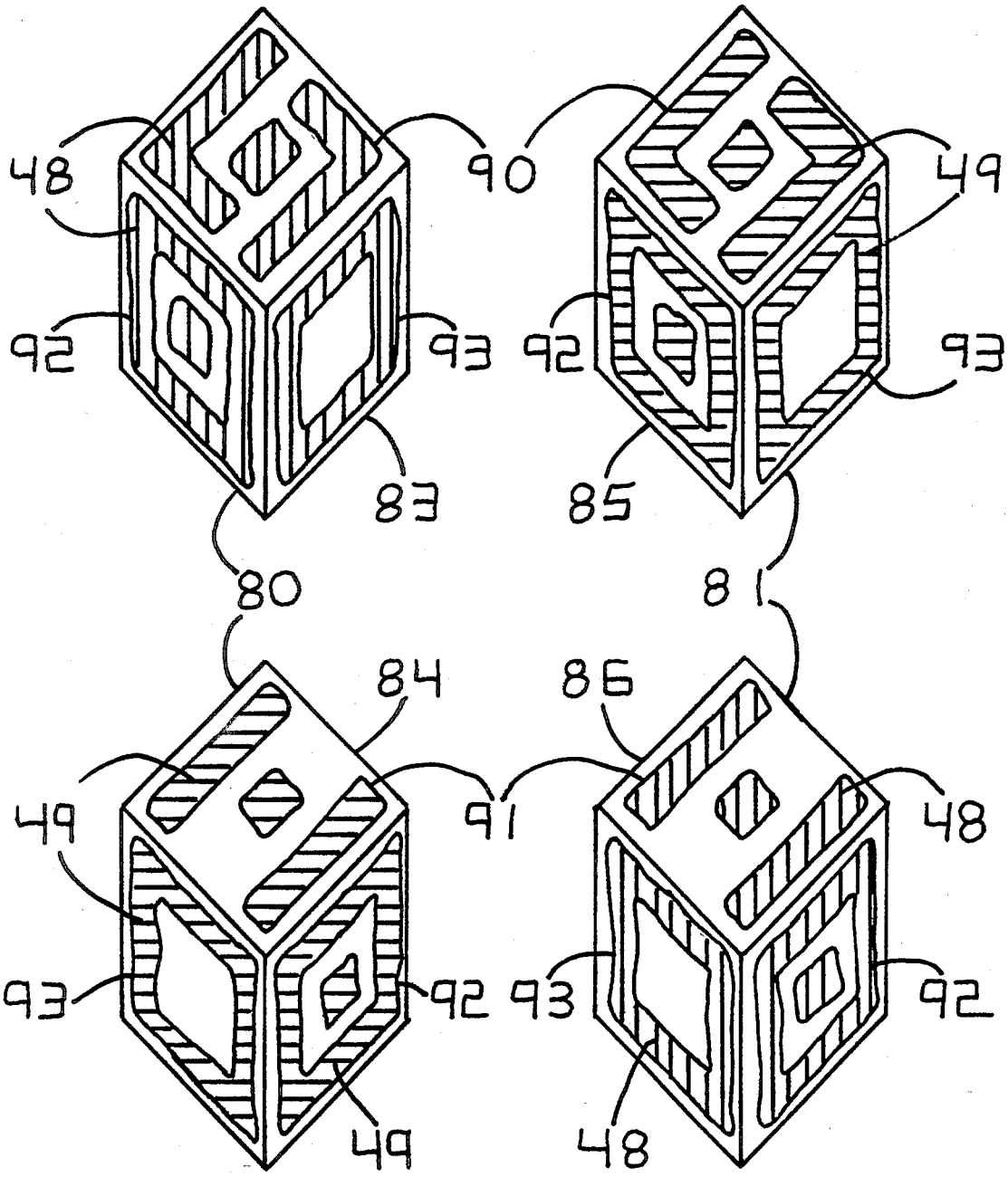
FIG. 5 is a detailed view of a pair of game cubes showing the colored symbols on the faces of each cube.

The game apparatus according to the invention includes a game board 10 which has four sides 12 and a surface 14 with holes 16 and spaces 18. The holes form three vertical columns 20,21,22. The inner-column 20 has one inner-hole 23 and two outer-holes 24,25.

Each outer-column 21,22 has two groups of holes. The outer-column 21 consists of the score-group 30 and the time-group 31. The outer-column 22 consists of the time-group 33 and the score-group 32.

The spaces form a grid 38 of horizontal, vertical and diagonal rows. The grid is separated from the sides 12 of the board by a continues margin 39. There is only one mid-horizontal 40 and only one mid-vertical 41 row of spaces. The mid-vertical and mid-horizontal rows intersect at a center-space 43.

The columns 20,21,22 are superimposed over the grid 38 of spaces in such a way that the holes of the outer columns are inside of the margin 39 and the holes of the inner-column are inside of the mid-vertical row 41. The inner-hole 23 is inside the center-space 43.

The outer hole 24 is inside of the goal space 44. The outer hole 25 is inside of the goal space 45. Each goal space is equal distance from the center space. The spaces adjacent with each goal space constitute a goal-area 46,47. The spaces of each goal area have the same color. The spaces of the goal area 46 have a different color 48 from the color 49 of the spaces of the goal area 47.

Each score group has seven holes. Each time-group has five holes. The hole 50 is the first hole of the score group 30. The hole 51 is the first hole of the time group 31. The hole 52 is the first hole of the score-group 32. The hole 53 is the first hole of the time-group 33. The other holes of each group being numbered sequentially.

FIG. 2

The pieces 60,61,62 are designed to fit on the spaces of the grid. Each piece has a top 63 and a hole 64. The pieces are classifiable into three types. The short pieces 60 are called guards. The medium pieces 61 are called forwards. The tall pieces 62 are called centers.

The pieces are divisible into two color contrasting sets. The pieces of one set have the same color 48 as the spaces of the goal area 46. The pieces of the other set have the same color 49 as the spaces of the goal area 47. Each player uses their pieces to defend the goal area having the same color as the color of their pieces.

Guards are shorter than forwards and centers. Forwards are taller than guards, but shorter than centers. Centers are taller than guards and forwards. All pieces are equal to pieces of their own type.

Although each set has eight pieces: 3 guards, 3 forwards and 2 centers; each player can use only five pieces on the spaces at a time. In this way, the players can use different combinations of pieces in the game.

Pieces move in a straight line along the horizontal, vertical and diagonal rows. Pieces do not move through pieces or pegs. Pieces may move through the spaces having holes, but they may not occupy these spaces.

The types of pieces differ in their range of movement and range at which they shoot the object-peg. Guards move and shoot 1 to 4 spaces. Forwards move and shoot 1 to 3 spaces. Centers move and shoot 1 or 2 spaces.

FIG. 3

The pegs 70,71 have a stock 72 and a head 73 with a top 74. The stocks are designed to fit in the holes of the surface of the board. The top of the peg 70 has a color 48. The top of the peg 71 has a color 49.

There are four colored pegs. These pegs are divisible on the basis of color into equal sets. Two of the pegs have the same color 48 as that of the goal area 46. The other two pegs have the same color 49 as that of the goal area 47.

One peg of each set is called a time-peg. Each time-peg is used in the holes of a time-group. Initially, the time-pegs are positioned in the fifth hole of the time group adjacent with the goal area having a different color.

One peg of each set is called a score-peg. Each score-peg is used in the holes of a score-group. Initially, the score-peg are positioned in the first holes of the score-group adjacent with the goal area having a different color.

FIG. 4

The peg 76 has a stock 72 and a head 73 with a top 74. The stock is designed to fit in the holes of the board and in the holes of the pieces. The top of the head of the peg 76 has a color 79 differing from the colors 48 and 49.

The peg 76 is called the object-peg. The color of the object-peg differs from that of the goal areas, pieces, and other pegs. The object-peg is used in the holes of the inner-column and in the holes of the pieces. Initially the object-peg is positioned in the inner-hole.

FIG. 5

The cubes 80,81 are designed to be rolled on a flat surface to the side of the board 10. The cube 80 is shown with a front view 83 and a back view 84. The cube 81 is shown with a front view 85 and a back view 86.

Each cube has six faces. Each face has only one symbol 90,91,92,93. The symbol 90 means steal. The symbol 91 means intercept. The symbol 92 means block. The symbol 93 means defend. The faces of each cube have one each of the symbols meaning steal and intercept, and two each of the symbols meaning block and defend.

The symbols on the faces of the front view 83 of the cube 80 have the same color 48 as the goal area 46. The symbols on the faces of the back view 84 of the cube 80 have the same color 49 as the goal area 47.

The symbols on the faces of the front view 85 of the cube 81 have the same color 49 as the goal area 47. The symbols on the faces of the back view 86 of the cube 81 have the same color 48 as the goal area 46.

Each cube has three symbols each of the colors 48 and 49. Each cube has a symbol 92 and 93 of each color. The symbols 90 and 91 of each cube differ in color. That is, the symbol 90 of the cube 80 has the same color as the symbol 91 of the cube 81.

Initial Set

The pegs are positioned in the holes of the board. The object-peg is positioned in the center space. The time and score pegs are positioned respectively in the fifth and first holes of the time and score groups adjacent with the goal area differing in color from themselves.

Each player selects a starting team of 5 pieces and a cube. One of the players rolls their cube. The player whose set matches in color the symbol on the upper face of the cube, places a piece on a space. The players alternately place pieces on spaces, until each has placed 5 pieces on the grid. The other player rolls a cube. The player whose set matches in color the symbol on the upper face of the cube, is the offensive player in the first turn.

During the initial set players may not place pieces on the spaces with holes, or on the spaces of the goal areas. It is advisable that each player place at least one piece within range of the center-space, in order to be able to take the object-peg.

Turns and Plays

Players take turns being the offensive player. The offensive player controls the object-peg. The offensive pieces are used to maneuver the object-peg towards the oppositions goal space. Offensive players score by positioning the object-peg in the oppositions goal hole; in such a way, that the defensive player is unable to remove it.

The defensive player defends their goal space from the object-peg. The defensive pieces are used to block the movement of the offensive pieces and the object peg. The defensive player attempts to force the offensive player to turn over the object peg. If the offense does not turn over the object-peg; then the defense must, eventually, move the oppositions score-peg. With each score and turn over the players change roles.

During a tūrn, the offensive and defensive players alternately make plays. Each play ends with the move of a peg. All offensive plays end with the move of the object-peg. Defensive plays may end either with the move of the object-peg, the oppositions score peg or the oppositions time peg.

Offensive Plays

All offensive plays have the same form. First none, one or two offensive pieces are moved without the object-peg. Second the object-peg is moved to, along with, or away from an offensive piece. The four ways offensive pieces can move the object-peg are listed below.

1. Take

The object-peg is in the center space or the offenses goal space. An offensive piece must be on a space adjacent with the space having the object-peg. A player moved the object-peg from the hole of the space to the adjacent piece. We say that the piece takes the object-peg. The piece having the object-peg is called the keeper.

2. Pass

The object-peg is in the hole of an offensive piece on the same row with another offensive piece. The offensive player moves the object-peg along a row from one piece to another piece. We say that the piece passes the object-peg. The piece passing the object-peg is called the passer. The piece receiving the object-peg is called the receiver.

3. Carry

The object-peg is in the hole of an offensive piece. The offensive player moves the piece with the object-peg along a row. We say that the pieces carries the object-peg.

4. Shoot

The object-peg is in the hole of an offensive piece on a row having the oppositions goal space. The offensive player moves the object-peg from a piece along a row to the hole of the oppositions goal space. We say that the piece shoots the object-peg. The piece shooting the object-peg is called the shooter.

Defensive Plays

During a defensive play, the defensive player does one or more of the following: call violation, move the object-peg to their own goal space, role the cubes, award the object-peg to a new piece or the center space, move pieces, move the oppositions time-peg, and move the oppositions score-peg.

The logic of a defensive play is as follows. If the defensive player calls a violation then the object-peg is move to a hole of a space. If the object-peg is in a situation then the defensive player may roll a pair of cubes. If the upper symbol of one or both of the cubes corresponds with a situation, then the defensive player moves the object-peg to a new piece or to the center space. If a player fails to role the cubes, or one or both of the symbols do not correspond with the situation; then, the defensive player has the option of moving zero, one or two of his pieces and must also move the oppositions time-peg. During a play; if the defensive player is unable to call a violation, move the object-peg or the time-peg, then they must move the oppositions score-peg.

1. Time Peg

If the object-peg is in a piece then the defensive player must move the opposition time-peg. The time-peg is reset with each change in control of the object-peg. If it is the first defensive play of a turn; and the time-peg is in the number 2 through 5 holes, then it is moved to the number one hole. However, if the time peg is in the number one hole then it is moved to the number 2 hole. With each successive defensive play in which the object-peg is not move, the time peg is moved to the next hole of its group.

2. Score Peg

If the object-peg is in the defenses goal space and they are unable to award the object-peg to a new piece or space, then the defensive player must move the oppositions score peg. The score-peg is moved from the number one hole to the number 2 hole of its group, and so on until the number 7 hole is reached. Once the score-peg is in the number 7 hole then the defense can not give up any more scores. If the offense scores and the score-peg is in the number seven hole, then the defender loses the game. Each play must end with the move of a peg.

Violations

With each violation the object-peg is turned over to the defense. The object-peg will be in an offensive piece or in the hole of a space. The object-peg is moved either to the defenses goal space or to the center space. The pieces are removed from the board. The pieces are reset, and the (new) offensive player makes an offensive play.

1. Time Violation

Once the time peg has reached the fifth hole, the offense has only one play left to score. If a piece has the object-peg, the time-peg is in the number 5 hole, and it is the defenses turn; then the defense calls a time violation. The defensive player is unable to move a peg at the end of the play.

The defensive player moves the object-peg from the offensive piece to the center space. The pieces are removed from the board and reset. On the first offensive play an offensive piece takes the object peg. The offense is not required to inbound the object-peg.

2. Recovery Violation

The object-peg is inside of a hole of the board. No offensive piece can move to the space adjacent with the object peg to take it. Consequently, the defensive player calls a recovery violation. The offensive player was unable to move a peg at the end of a turn.

The defensive player moves the object-peg from the center space or the oppositions goal space, to their own goal space. The pieces are removed from the board. The pieces are reset. On the first offensive play an offensive piece takes the object-peg. The offense is required to inbound the object-peg.

3. Goal-Area Violation

The object peg is inside of the hole of a piece and an offensive piece, which was not just moved their, is in the oppositions goal area, then the defensive player calls a violation. The offensive piece are not allowed in the oppositions goal area for two consecutive turns, unless the object peg is in the defenses goal space. Goal area violations are not called on pieces which just passed the object-peg.

The defensive player moves the object-peg from a piece to their own goal space. The pieces are removed from the board and reset. The (new) offensive player moves a piece to take the object-peg. The offense is required to inbound the object-peg.

Reset

When time and goal-area violations are called, the object-peg is inside of a piece. When recovery violations are called, the object-peg is in a hole of a space. After a time violation, the defensive player moves the object-peg to the center space. After a goal-area or recovery violation the defense moves the object-peg to the defenses goal-space.

The pieces are removed from the spaces of the grid. Each player selects a team of 5 pieces to put into play. Some of these pieces may be different from the ones removed. First the (new) offensive player places their 5 pieces on the spaces. Then the defensive player places their 5 pieces on the remaining spaces. Pieces may not be placed on the spaces with holes or the spaces of the goal area. It is advisable for the offensive player to place pieces adjacent with the object-peg.

After all the pieces are reset on the board, the offensive player makes an offensive-play. This play will end with an offensive piece taking the object-peg; thus avoiding a recovery technical.

Inbound

After time violations, the object-peg is not inbounded. After goal-area and recovery violations, and scores; the object-peg is inbounded from the (new) offenses goal area. In the case of a score, unlike that of a violation, the pieces are not reset. On the first offensive play an offensive piece takes the object-peg from the goal-hole. This piece can not leave the goal area with the object-peg.

Inbounding requires a piece on a space of the goal area to pass object peg, along a row, through the adjacent goal hole to a piece outside of the goal area. During the inbound a piece may not pass the object-peg through the center-space. A player is not required to inbound the object-peg during a turn. But failure to do so prevents them from scoring and will eventually result in a time-violation.

Although a piece may not move along with the object-peg outside of the goal area, the piece may move from space to space inside of the goal area.

Rolling the Cubes

Defensive players use their pieces to force the opposition into situations. In each situation the defender may roll the cubes. If one or more of the symbols on the upper faces of the cubes correspond with the situation, then the defender awards the object-peg to a new piece or the center hole.

The situations are: steal, intercept, block and defend. In each situation a defensive piece is adjacent with the keeper or shooter, or between the object-peg and the passer or shooter. In each situation the defensive piece is shorter, equal to or taller than the offensive piece. Shorters steal from tallers. Tallers intercept, block and defend from shorters. Equals steal, intercept, block and defend from equals.

At the start of each defensive turn; if the object-peg is in one or more situations, then the defense rolls the cubes. The symbols on the upper faces of each cube are compared to the situation. If the symbol corresponds with situation then we say that the symbol is positive.

Only one positive symbol is required for shorters to steal from tallers and for tallers to intercept, block and defend from shorters. Two positive symbols are required for equals to steal, intercept, block and defend from equals.

More than one situation can be present at one time. It is possible for each symbol to correspond with a different situation. In this case the defensive player may pursue either alternative. In each situation with the required number of positive symbols, the defense moves the object-peg to a new piece or to the center space. If the object-peg is awarded to a defensive piece, then we say that the object-peg has been turned over.

In determining the new location of the object-peg, the defensive player looks to the color of the symbols. The color of the symbols on the upper faces of the cubes will either: both match the defense, differ in color, or both match the color of the offense.

1. Steal

A defensive piece, called the stealer, is adjacent with the keeper. The stealer is shorter or equal with the keeper. If at least one "s" is on the faces of the cubes, then shorters may steal from tallers. If two "s"s are on the faces of the cubes, then equals may steal from equals. Tallers do no steal from shorters.

If the color of both symbols match the defense, then the object-peg is awarded to the stealer. If the symbols differ in color, then the object-peg is awarded to the shortest piece adjacent with the keeper. If both symbols have the color of the offense then the object-peg is awarded to the tallest piece adjacent with the keeper. If equal pieces of different colors are adjacent with the keeper, then the object-peg is awarded to the piece whose color matches that of the positive symbol.

2. Intercept

A defensive piece, called the interceptor, is on a row between the passer and receiver. The interceptor is taller or equal with the passer. If at least one "i" is on the faces of the cubes, then tallers may intercept the passes of shorters. If two "i"s is on the faces of the cubes, then equals may intercept equals. Shorters do not intercept from tallers.

If the color of both symbols match the defense or the symbols differ in color, then the object peg is awarded to the interceptor. If the color of both symbols match the offense, then the object-peg is awarded to the center space.

3. Block

A defensive piece, called the blocker, is adjacent with the shooter. The blocker is taller or equal with the shooter. If at least one "b" is on the faces of the cubes, then tallers may block the shots of shorters. If two "b"s are on the faces of the cubes, then equal may block the shots of equals. Shorters do not block the shots of tallers.

If the colors of both symbols match the defense, then the object-peg is awarded to the blocker. If the symbols differ in color then the object-peg is awarded to the shortest piece adjacent with the shooter. If the color of both symbols match the offense then the object-peg is awarded to the center-space. If equal pieces of different colors are adjacent with the shooter, then the object-peg is awarded to the piece whose color matches that of the positive symbol.

4. Defend

A defensive piece, called the defender, is on a row between the shooter and the defenses goal space. The defender is taller or equal with the shooter. If at least one "d" is on the faces of the cubes then tallers may defend against the shots of shorters. If two "d"s are on the faces of the cubes, then equals may defend the shots of equals. Shorters do not defend the shots of tallers.

If the color of both symbols match the defense, then the object-peg is awarded to the defender. If the symbols differ in color then the object-peg is awarded to the tallest piece, other than the defender, adjacent with the goal space. If both symbols match the color of the offense, then the object-peg is awarded to the shortest piece adjacent with the goal space. If equal pieces of differing colors are adjacent with the goal space, then the object-peg is awarded to the piece whose color matches that of the positive symbol.

As a general rule all unspecified situations are referred to the discretion of the defensive player. If two different symbols correspond with two different situations, then the defender may pursue either alternative. If equal pieces of the same color are adjacent with the keeper, shooter or goal space then the defense may awarded the object-peg to either of these pieces.

Alternatives

The grid of spaces on the board are shown as having 9 horizontal and 13 vertical rows. The grid could have any odd number of rows of spaces greater than 7.

The outer-columns of holes are shown as consisting of two groups consisting of respectively 5 and 7 holes. The number of holes of each group could be any number greater than 2, provided that the number of holes of a column does not exceed the number of horizontal rows of spaces.

The game pieces are shown as embodying 3 types of pieces. Their could be any number of types of pieces greater than 2, provided that the number of types is not greater than the number of pieces in a set.

The game pieces are shown as differing in color. All the pegs could be the same color provided that the object-peg's color did not match the color of the pieces.

The game cubes are shown as having only one of two symbols and two of two symbols on their faces. Any combination of these symbols could be on the faces of the cubes, provided that each symbol is represented on at least one face of each cube.

Generally speaking the players take turns controlling the object-peg. The offense uses their pieces to maneuver the object-peg towards the oppositions goal space. The defense attempts to force the offense into turning over the object-peg. Eventually the defense will move the offenses score-peg, if they are unable to cause a turn over.

All violations and some situations result in turn overs. In each situation, the defensive player rolls a pair of cubes. If the symbol on the upper face of the cubes correspond with the situation, then the object-peg is awarded to a new piece. If this piece is an offensive piece then the object-peg has been turned over.

Thus it can be seen that as the offense attempts to maneuver the object-peg towards the oppositions goal space, the defense attempts to force the offense into situations. The symbols on the cubes corresponding with the situations. Any combination of symbols on the faces of cubes corresponding with the situations between pieces on the space is considered to be within the scope of the invention.

This invention is not to be limited by the embodiment shown in the drawings and described in the description which is given by way of example and not of limitation, but only in accordance with the scope of the appended claims.

I claim:

1. A game apparatus consisting of:

a board having a plurality of sides and a surface with holes and spaces, said holes forming a plurality of vertical columns consisting of only one inner-column and a plurality of outer-columns, said inner-column having only one inner-hole and a plurality of outer-holes, each of said outer-columns having a plurality of groups of holes, said spaces forming a grid of horizontal, vertical and diagonal rows, said grid having only one mid-horizontal and only one mid-vertical row, said mid-vertical and said horizontal rows intersect at a center space, said grid being separated from said sides of said board by a continuous margin, said columns of holes being superimposed over said surface of said board in such a way that said inner-column occupies said mid-vertical row and said outer-columns occupy said margin, said inner-hole occupies said center space, each of said outer-holes occupies a space equal distance from said center space, a plurality of goal-spaces, each of said goal spaces being occupied by an outer-hole, a plurality of goal-areas, each of said goal areas including each of said spaces adjacent one of said goal spaces, a plurality of pieces each designed to occupy one of the spaces, a plurality of pegs designed to fit in the holes on the surface, and a plurality of cubes, each of said cubes having a plurality of faces each of said faces of each of said cubes having only one symbol thereon, a plurality of said faces of each cube having a symbol the same as another symbol on a face of said cube, a plurality of said faces of each cube having a symbol differing from said symbols on said other faces of said cube.

2. A game apparatus as defined in claim 1 in which: each of said pieces having a top with a hole, said pieces are classified into a plurality of types, each of said pieces of one of said types having the same height as each other piece of said type.

3. A game apparatus as defined in claim 2 in which: each of said pegs having a head with a top, each of said pegs being designed to fit in said holes of said pieces.

4. A game apparatus as defined in claim 1, 2, or 3 in which: each of said spaces of each of said goal areas having the same color, said color of each of said goal areas differing from said color of said other goal area, said pieces being divided into two sets each of said pieces of a set having the same color, each of said pieces of each of said sets having a color the same as only one of said goal areas, only one of said pegs having a color differing from said color of both of said goal areas, each other of said pegs having a color the same as only one of said goal areas, each of said symbols of each of said faces of each of said cubes having the same color as only one of said goal areas, each of said symbols on a plurality of faces of each of said cubes differing in color, each of said symbols being on only one face of a plurality of said cubes differing in color from said other symbol on only one face of said cube.

5. A method of playing a game on a board having a grid of spaces, a margin, only one center-space, a plurality of goal-spaces, a plurality of goal-areas, only one hole inside of said center space, only one hole inside of each of said goal spaces and a plurality of groups of holes occupying said margin; said method comprising:

assigning said goal spaces equally among the players, positioning only one peg in said inner-hole, positioning only one peg in only one hole of each of said groups of holes, dividing said pieces into sets, placing a plurality of said pieces of each of said sets on said spaces of said grid, moving said peg in said inner-hole to the hole of an adjacent piece, moving said piece having said peg along said rows of spaces, moving said peg along a row from one piece to the hole of another piece, moving said peg from a piece along a row to one of said outer-holes, moving said pieces without said peg along said rows of spaces, said pieces being immovable through said peg and said other pieces, said pieces being movable through but not onto said spaces having holes, rolling a plurality of cubes when at least one of said pieces has a predetermined relation with only one of said pegs so as to create a situation, said cubes when coming to rest showing a symbol on the upper face thereof, said symbol being positive if it matches said situation, awarding said peg to a piece only if at least one of said symbols is positive, awarding said peg to a piece by moving said peg from one of said pieces to another of said pieces, awarding said peg to a piece by moving said peg from an outer-hole to a piece, awarding said peg to said center hole by moving said peg from a piece to the center hole, moving said pegs in said holes of said groups between said holes of only one of said groups.

6. A method as in claim 5 in which; positioning said peg having a color differing from said color of both of said colors of said goal spaces in said inner-hole, positioning each of said pegs having the same color as one of said goal areas in said hole of said groups adjacent with said goal area differing in color with said color of said peg, each of said players using the set of pieces having the same color as the color of the spaces of the goal area adjacent with the goal space assigned to said player, moving said peg in said inner-hole to an adjacent piece having the same color as the color of the symbol of one of said cubes, moving said peg in a piece to another piece having the same color, moving the peg in a piece to the outer-hole of a goal-space being adjacent with a goal area differing in color with said piece, awarding said peg to a piece having the same color as the color of both of said symbols on the faces of both of said cubes, moving said peg of one of said groups from one hole to another hole of said group only if said peg is outside of said outer-hole of said goal space adjacent with said group of holes, moving said peg of one of said groups from one hole to another hole of said group only if said peg is inside of said outer hole of said goal-space adjacent with said group of holes.

7. A method as defined in claim 5 wherein a player makes plays by moving a plurality of pieces, each of said plays ending with a move of only one of said pegs.

* * * * *